US008770455B2

(12) United States Patent
Clifton, Jr.

(10) Patent No.: US 8,770,455 B2
(45) Date of Patent: Jul. 8, 2014

(54) ADJUSTABLE BELT MOUNT FOR SECURING ARTICLES TO BELTS OF VARYING WIDTH

(75) Inventor: Norman E. Clifton, Jr., Jacksonville, FL (US)

(73) Assignee: Safariland, LLC, Jacksonville, FL (US)

( * ) Notice: Subject to any disclaimer, the term of this patent is extended or adjusted under 35 U.S.C. 154(b) by 218 days.

(21) Appl. No.: 12/764,252

(22) Filed: Apr. 21, 2010

(65) Prior Publication Data

US 2010/0264177 A1 Oct. 21, 2010

Related U.S. Application Data

(60) Provisional application No. 61/214,203, filed on Apr. 21, 2009.

(51) Int. Cl.

| | |
|---|---|
| ***A45F 5/00*** | (2006.01) |
| ***F41C 33/00*** | (2006.01) |
| ***F41C 33/02*** | (2006.01) |

(52) U.S. Cl.
USPC ..... 224/674; 224/672; 224/660; 224/663; 224/666; 24/182

(58) Field of Classification Search
USPC ..... 224/197–200, 660, 663, 666, 667, 671, 224/674, 251, 672; 24/163 R, 182, 198
See application file for complete search history.

(56) References Cited

U.S. PATENT DOCUMENTS

| | | | | |
|---|---|---|---|---|
| 4,749,112 | A * | 6/1988 | Harper | 224/553 |
| 5,584,423 | A * | 12/1996 | Wang | 224/197 |
| 6,311,881 | B1 * | 11/2001 | Kamiya | 224/195 |
| 7,657,977 | B2 * | 2/2010 | Clifton, Jr. | 24/170 |
| 7,866,515 | B1 * | 1/2011 | Buis et al. | 224/197 |
| 7,971,762 | B2 * | 7/2011 | Clifton, Jr. | 224/197 |
| 2004/0134945 | A1 * | 7/2004 | Kincaid et al. | 224/269 |
| 2007/0226958 | A1 * | 10/2007 | Clifton, Jr. | 24/3.12 |
| 2008/0313861 | A1 | 12/2008 | Clifton, Jr. | |
| 2009/0307826 | A1 * | 12/2009 | Rogers et al. | 2/422 |

* cited by examiner

*Primary Examiner* — Adam Waggenspack
(74) *Attorney, Agent, or Firm* — Arthur G. Yeager

(57) ABSTRACT

An adjustable belt mount includes a belt mount body and a generally L-shaped belt sizing insert. The belt mount body defines a belt aperture adapted to receive a belt therethrough, and first and second belt sizing slots being spaced and extending parallel to each other and communicating with the belt aperture. The belt mount body also includes a forward extension adapted to releasably connect an accessory thereto. The belt aperture is adapted to receive belts of various widths therethrough. The belt sizing insert is arranged in the belt aperture, and includes a planar portion carrying a retaining body extending from a first side thereof and releasably received by either of the first and second belt sizing slots, to accommodate belts of differing widths, and a delimiting portion extending generally perpendicular from a second side thereof. The delimiting portion can thereby form varying predetermined width passageways within the belt aperture.

20 Claims, 11 Drawing Sheets

ADJUSTABLE BELT MOUNT FOR SECURING ARTICLES TO BELTS OF VARYING WIDTH

CROSS-REFERENCE TO RELATED APPLICATION

This application claims the benefit of U.S. Provisional Application Ser. No. 61/214,203, filed Apr. 21, 2009, the contents of which application are herein incorporated by reference in their entirety.

FIELD OF THE INVENTION

The present invention relates to belt mounts, and more particularly, to belt mounts adapted for mounting accessories to belts.

BACKGROUND OF THE INVENTION

Known in the art are standardized mounting rail systems for mounting scopes, lights, and similar accessories to compatibly-equipped firearms. One such mounting rail system is called the Picatinny rail system. A Picatinny rail is a bracket used on a firearm to provide a standardized mounting platform. The rail comprises a series of ridges interspersed with flat "spacing slots".

Also known in the art is an adjustable belt clamp to which articles can be attached. The belt clamp fastens onto a belt and is adjustable to accommodate belts of various widths. See, for example, U.S. Patent Publications 2007/0226958 to Clifton, Jr. and 2008/0313861 to Clifton, Jr.

SUMMARY OF THE INVENTION

In view of the foregoing, it is an object of the present invention to provide an improved belt mount. According to an embodiment of the present invention, an adjustable belt mount includes a belt mount body and a generally L-shaped belt sizing insert.

The belt mount body has defined therein a belt aperture adapted to receive a belt therethrough, and first and second belt sizing slots being spaced and extending parallel to each other and communicating with the belt aperture. The belt mount body can also include a forward extension adapted to releasably connect an accessory thereto.

The belt aperture is adapted to receive belts of various widths therethrough and can be formed between an inner generally rectangular wall and a spaced outer generally rectangular wall substantially parallel thereto and having end walls therebetween, with the belt sizing slots extending substantially parallel to the end walls.

The generally L-shaped belt sizing insert is arranged in the belt aperture, and includes a planar portion carrying a retaining body extending from a first side thereof and releasably received by either of the first and second belt sizing slots, to accommodate belts of differing widths, and a delimiting portion extending generally perpendicular from a second side thereof. The delimiting portion can thereby form varying predetermined width passageways between itself and one of the end walls.

The belt mount is envisioned to be constructed primarily of glass-filled nylon, although other materials might also be used, depending on the application and user preferences and requirements.

These and other objects, aspects and advantages of the present invention will be better understood in view of the drawings and following detailed description of preferred embodiments.

DETAILED DESCRIPTION OF PREFERRED EMBODIMENTS

Figure 1:
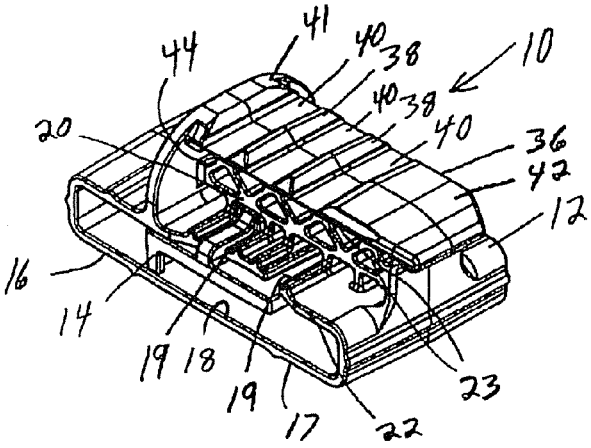
FIG. 1 is a left side perspective view of an adjustable belt mount including a body and a removable belt sizing insert, in accord with the present invention.

Embodying the principles of the present invention is an adjustable belt mount for securing articles to belts that fall within an adjustable range of widths. A preferred embodiment of the adjustable belt mount is depicted in FIGS. 1-12 and designated generally by reference numeral 10.

Referring now to FIG. 1, the belt mount 10 comprises a body 12 and a belt sizing insert 14. A belt 92 (see FIGS. 11 and 12) is inserted through the body 12 of the belt mount 10, as described below with reference to FIGS. 6-10, to secure the belt mount 10 to the belt 92. The sizing insert 14 can be inserted into the body 12 of the belt mount 10 in different locations and in different attitudes, as described below with reference to FIG. 6 and with reference to FIGS. 7-10. The location of the sizing insert 14 dictates a maximum width for any belt 92 that is to be received into the body 12. The body 12 can still receive belts 92, however, even when the belt sizing insert 14 is entirely removed from the body 12, as described below with reference to FIG. 6. In the present embodiment, the belt mount 10 is constructed of glass-filled nylon. In alternate embodiments, a belt mount 10 can be constructed of other materials, such as sturdy plastic.

Figure 2:
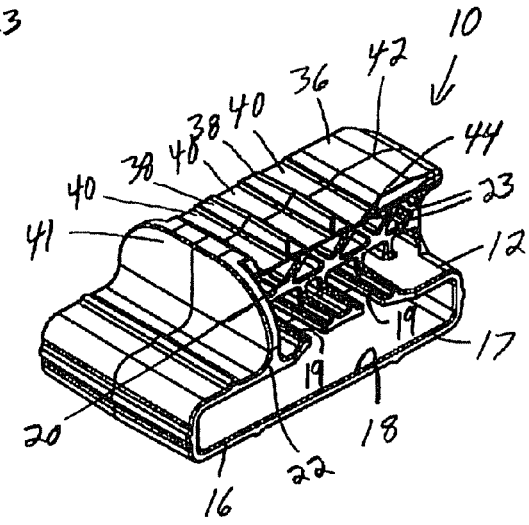
FIG. 2 is a bottom perspective view of the body of the belt mount shown in FIG. 1 with the belt sizing insert removed.
Figure 3:
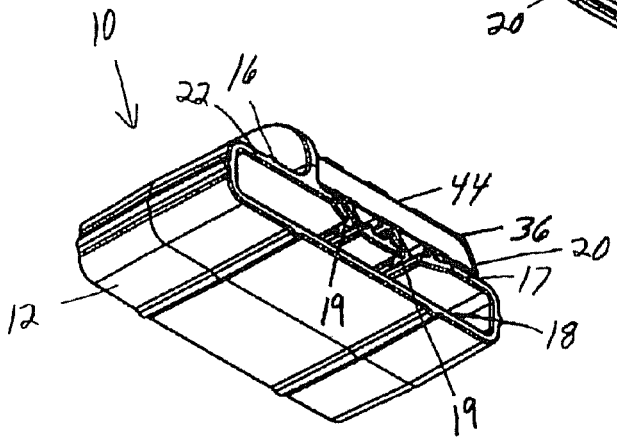
FIG. 3 is a rear perspective view of FIG. 2.

Referring now to FIGS. 2 and 3, the body 12 of the belt mount 10 comprises a belt aperture 18, a pair of spaced sizing slots 19, a forward extension 20, and a rail 36. The belt aperture 18 extends substantially the length of the body 12 of the belt mount 10 and is used to receive the belt 92 (see FIGS. 11 and 12). The forward extension 20 is located forward of the belt aperture 18 and substantially above a lower portion 16 of the body 12. The forward extension 20 contains a plurality of dished out areas 23 (see FIG. 2) that are included to reduce material costs and the weight of the body 12, as is commonly known in the art of plastic molding. The sizing slots 19 extend through a wall 22 of the body 12 that is positioned between the belt aperture 18 and the forward extension 20 and into a portion of the forward extension 20. Each sizing slot 19 is dimensioned for receiving the belt sizing insert 14 (see FIGS. 1, 4, and 5), as described below with reference to FIGS. 7-10. The rail 36 is supported by the forward extension 20 and is positioned forward thereof.

Referring now to FIG. 2, the rail 36 of the body 12 of the belt mount 10 is used to receive accessories, such as scopes, lights, and similar devices, that are compatible with the rail 36, as is known in the art. The rail 36 comprises ridges 38 with intervening slots 40. Opposing sides 44 of the rail 36 slope inwardly at approximately a forty-five degree angle. A top surface of an upper portion 42 of the rail fails to rise above top surfaces of the ridges 38, while a top surface of a lower portion 41 of the rail does rise above the top surfaces of the ridges 38.

Figure 4:
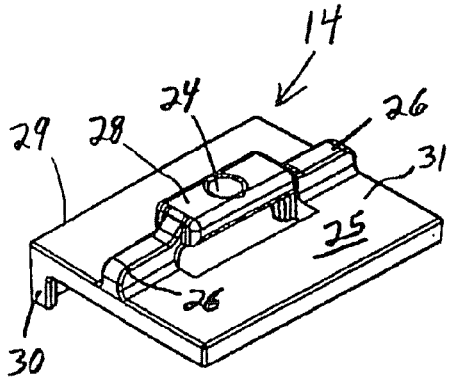
FIG. 4 is a front perspective view of the belt sizing insert of the belt mount shown in FIG. 1.
Figure 5:
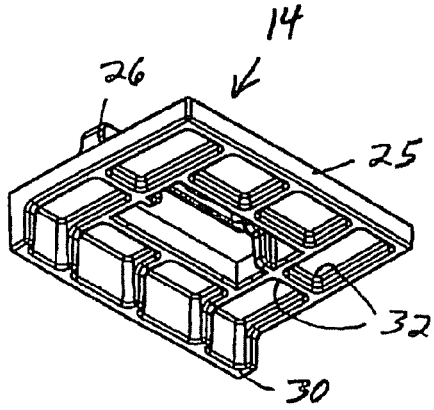
FIG. 5 is a rear perspective view of FIG. 4.

Referring now to FIGS. 4 and 5, the belt sizing insert 14 is generally L-shaped and comprises a plurality of dished out areas 32 (see FIG. 5), a planar portion 25, and a delimiting portion 30. The dished out areas 32 are included to reduce material costs and the weight of the sizing insert 14, as is commonly known in the art of plastic molding. The delimiting portion 30 is formed integral with the planar portion 25. The delimiting portion 30 extends substantially perpendicuarly from an end 29 (see FIG. 4) of the planar portion 25 and also extends the length thereof, thereby accounting for the generally L-shape of the sizing insert 14.

Continuing with FIGS. 4 and 5, extending from an upper surface 31 of the planar portion 25 is a pair of spaced guide tabs 26 and a retaining body 28. The retaining body 28 is located between the pair of guide tabs 26, with opposing ends of the retaining body 28 formed integral with a respective end of each guide tab 26. A top surface of the retaining body 28 extends forward of top surfaces of the guide tabs 26. The guide tabs 26 are used to guide the belt sizing insert 14 into one of the sizing slots 19 (see FIGS. 1-3 and 6-10), while the retaining body 28 is used to secure the sizing insert 14 within the sizing slot 19, as described below with reference to FIGS. 7-10.

Still referring to FIGS. 4 and 5, a receiving detent 24 is located approximately in the center of the top surface of the retaining body 28. The receiving detent 24 is a shallow circular depression used for receiving a locking boss 21 (see FIGS. 6-10) of the body 12 (see FIGS. 1-3 and 6-10) of the belt mount 10, as described below with reference to FIGS. 7-10. When the receiving detent 24 encounters the locking boss 21, the locking boss 21 snaps into the receiving detent 24, thereby securing the sizing insert 14 within the body 12 of the belt mount 10.

Referring now to FIGS. 7-10, as mentioned above with reference to FIG. 1, the belt sizing insert 14 is inserted into one of the sizing slots 19 of the body 12 of the belt mount 10, thereby dictating a maximum width for any belt 92 (see FIGS. 11 and 12) that is to be received into the body 12. To do so, the guide tab 26 of the sizing insert 14 is placed into the sizing slot 19 and the guide tab 26 and the retaining body 28 of the sizing insert 14 are pushed into the sizing slot 19. The retaining body 28 frictionally engages the sizing slot 19 as it passes through the sizing slot 19, until the sizing insert 14 snaps into place. The snapping into place occurs when the receiving detent 24 of the sizing insert 14 encounters the locking boss 21 of the body 12, whereupon the locking boss 21 snaps into the receiving detent 24, thereby securing the sizing insert 14 within the body 12. To remove the belt sizing insert 14 from the body 12, pressure is applied to a side of the belt sizing insert 14 to force the sizing insert 14 out of the sizing slot 19. Note that the belt sizing insert 14 can be inserted into the body 12 with either the delimiting portion 30 of the sizing insert 14 nearer an upper portion 17 of the body 12 than an opposing end of the planar portion 25 of the sizing insert 14, or with the delimiting portion 30 nearer the lower portion 16 of the body 12 than the opposing end of the planar portion 25.

Figure 6:
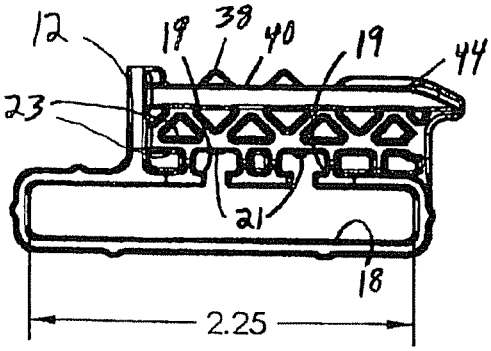
FIG. 6 is a left side view of the body of the belt mount shown in FIG. 2 with the belt sizing insert removed to allow the belt mount to accept a 2.25 inch wide belt.
Figure 7:
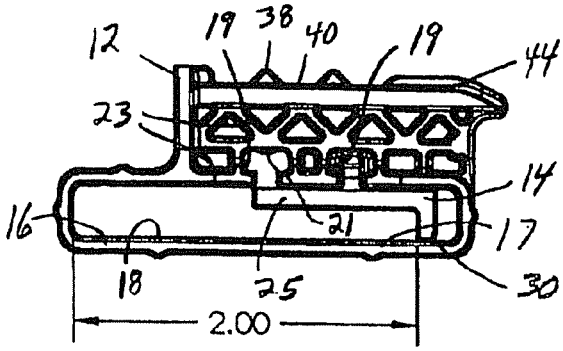
FIG. 7 is a left side view of the belt mount shown in FIG. 1 with the belt sizing insert positioned to allow the belt mount to accept a 2 inch wide belt.

Referring now to FIG. 6, when the belt sizing insert 14 is removed from the body 12 of the belt mount 10, any belt 92 (see FIGS. 11 and 12) with a width of up to approximately 2.25 inches can be inserted into the belt aperture 18 of the body 12 of the belt mount 10. To do so, an end of a belt 92 of appropriate width is inserted into the belt aperture 18, and the belt 92 is moved through the belt mount 10 until a desired position along the length of the belt 92 is reached. The belt mount 10 is positioned on the belt 92 such that the upper portion 17 of the body 12 is nearer the head of a wearer 90 (see FIGS. 11 and 12) while the lower portion 16 of the body 12 is nearer the feet of the wearer 90.

Referring now to FIGS. 7-10, the belt sizing insert 14 is inserted into the belt aperture 18 of the body 12 of the belt mount 10 to dictate the maximum width for any belt 92 (see FIGS. 11 and 12) that is to be received into the body 12. To do so, the sizing insert 14 is pushed into one of the sizing slots 19 of the body 12, as described above with reference to FIGS. 7-10. The sizing insert 14 can be inserted into the selected sizing slot 19 either with the delimiting portion 30 of the sizing insert 14 nearer the upper portion 17 of the body 12 than the opposing end of the planar portion 25 of the sizing insert 14, or with the delimiting portion 30 nearer the lower portion 16 of the body 12 than the opposing end of the planar portion 25. The belt 92 can now be inserted into the belt aperture 18 of the body 12 of the belt mount 10. To do so, the end of the belt 92 of appropriate width is inserted into the belt aperture 18, and the belt 92 is moved through the belt mount 10 until a desired position along the length of the belt 92 is reached. The belt mount 10 is positioned on the belt 92 such that the upper portion 17 of the body 12 is nearer the head of the wearer 90 (see FIGS. 11 and 12) while the lower portion 16 of the body 12 is nearer the feet of the wearer 90.

Figure 8:
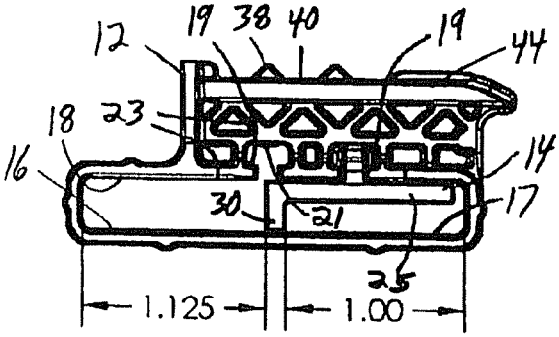
FIG. 8 is a left side view of the belt mount shown in FIG. 1 with the belt sizing insert positioned to accept a 1.125 inch wide belt or a 1 inch wide belt.
Figure 9:
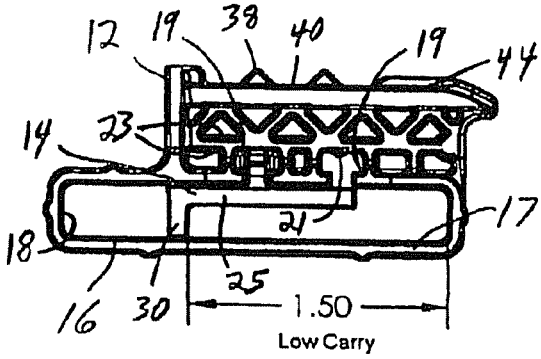
FIG. 9 is a left side view of the belt mount shown in FIG. 1 with the belt sizing insert positioned to allow the belt mount to accept a 1.5 inch wide belt carried in a lower portion of the body of the belt mount.
Figure 10:
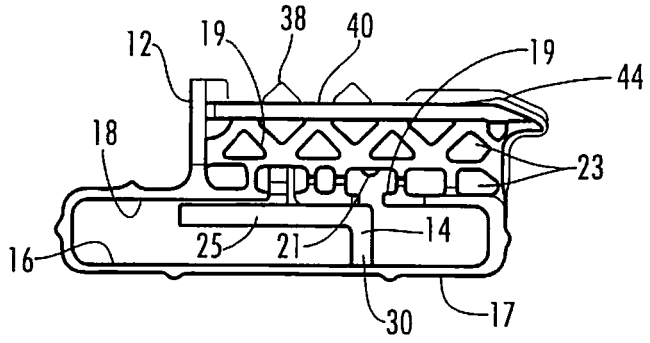
FIG. 10 is a left side view of the belt mount shown in FIG. 1 with the belt sizing insert positioned to allow the belt mount to accept a 1.5 inch wide belt carried in an upper portion of the body of the belt mount.

Continuing with FIGS. 7-10, FIG. 7 shows a placement of the belt sizing insert 14 that permits belts 92 of up to approximately two inches in width to be secured to the belt mount 10. FIG. 8 shows a placement of the belt sizing insert 14 that permits belts 92 of up to approximately 1.125 inches in width to be secured to the belt mount 10. Note in FIG. 8, however, a portion of the belt aperture 18 on one side of the delimiting portion 30 allows for belts 92 of width up to approximately 1.125 inches, while a portion of the belt aperture 18 on the opposing side of the delimiting portion 30 only allows for belts 92 having a width of up to approximately one inch. FIGS. 9 and 10 show a placement of the belt sizing insert 14 that permits belts 92 of up to approximately 1.5 inches in width to be secured to the belt mount 10. Note in FIGS. 9 and 10, however, that the orientation of the sizing insert 14 is different in FIG. 9 than it is in FIG. 10. Note also in FIGS. 9 and 10 that the belt 92 can be placed on one side of the delimiting portion 30 to allow the belt mount 10 to ride lower (see FIG. 9) on the belt 92, while placing the belt 92 on the opposing side of the delimiting portion 30 allows the belt mount 10 to ride higher (see FIG. 10) on the belt 92.

Figure 11:
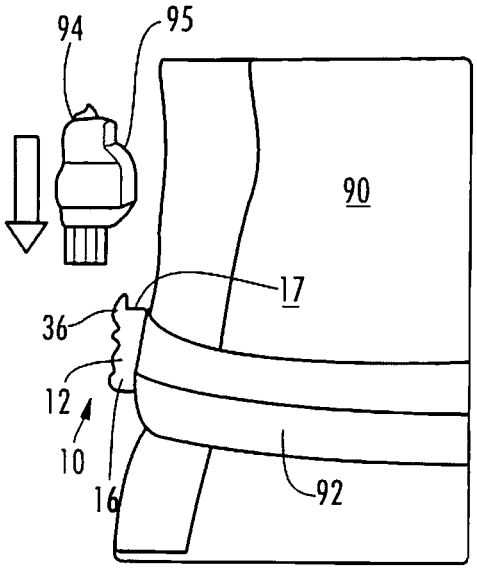
FIG. 11 is a front elevational view of a wearer equipped with the belt mount shown in FIG. 1 secured to a belt in preparation to attaching a light to the belt mount.
Figure 12:
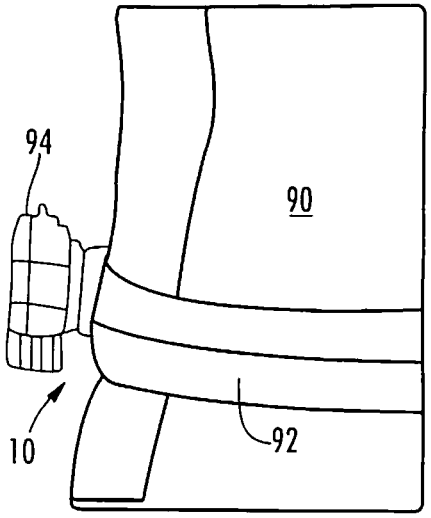
FIG. 12 is a front elevational view of the wearer equipped with the belt mount secured to the belt shown in FIG. 11 with the light attached to the belt mount.

Referring now to FIGS. 11 and 12, once the belt mount 10 has been secured to the belt 92, as described above with reference to FIG. 6 and with reference to FIGS. 7-10, compatible articles can be attached to the belt mount 10. To do so, a compatible rail channel 95 (see FIG. 11) of an article, such as a light 94, is aligned with the rail 36 (see FIG. 11) of the body 12 (see FIG. 11) of the belt mount 10. The rail channel 95 of the light 94 is then moved onto and along the rail 36 toward the lower portion 16 (see FIG. 11) of the body 12 until the light 94 cannot be moved further onto the rail 36. To remove the light 94, the light 94 is simply moved back along toward the upper portion 17 (see FIG. 11) of the body 12 until the rail channel 95 of the light 94 comes away from the rail 36. Note that it is also possible to attach an article to the belt mount 10 prior to securing the belt mount 10 to the belt 92.

FIGS. 13-23 depict a second preferred embodiment of an adjustable belt mount 110, in accord with the present invention. In a number of respects, the present embodiment 110 is substantially the same as the first preferred embodiment 10 (see FIGS. 1-12). The belt mount 110 of the present embodiment, however, is configured to clip onto the belt 92 (see FIGS. 11 and 12) and lock there.

Figure 13:
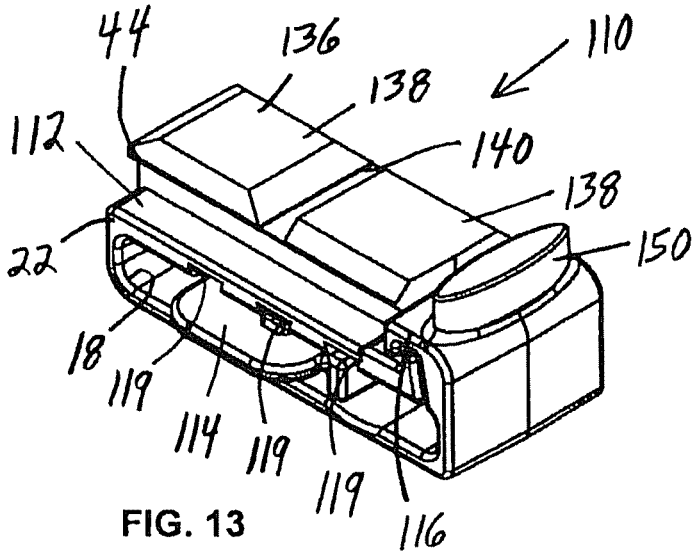
FIG. 13 is a bottom perspective view of a second embodiment of an adjustable belt mount including a body and a removable belt sizing insert, in accord with the present invention.

Referring now to FIG. 13, the belt mount 110 comprises a body 112 and a belt sizing insert 114. A belt 92 (see FIGS. 11 and 12) can be inserted through the body 112 of the belt mount 110, as described above with reference to FIGS. 6-10, to secure the belt mount 110 to the belt 92. The sizing insert 114 can be inserted into the body 112 of the belt mount 110 in different locations and in different attitudes, as described above with reference to FIG. 6 and with reference to FIGS. 7-10.

Figure 16:
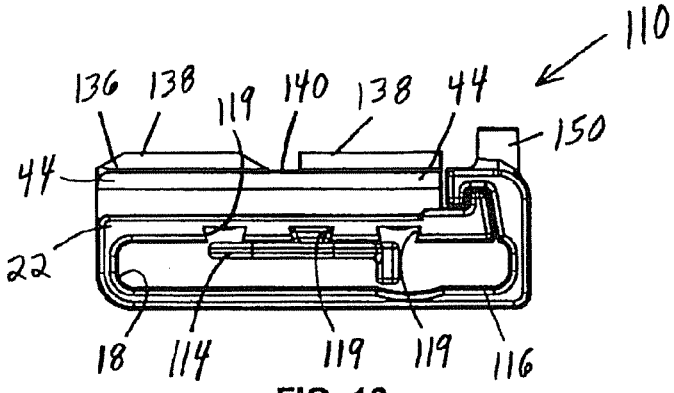
FIG. 16 is a right side view of the belt mount shown in FIG. 13.
Figure 17:
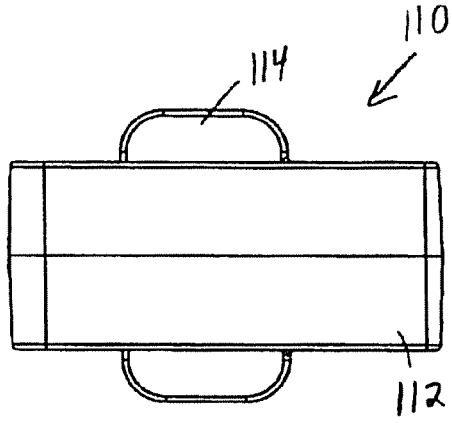
FIG. 17 is a rear view of FIG. 16.
Figure 18:
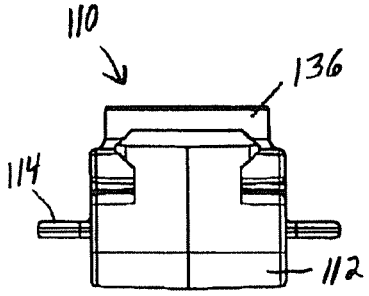
FIG. 18 is a top plan view of FIG. 16.
Figure 19:
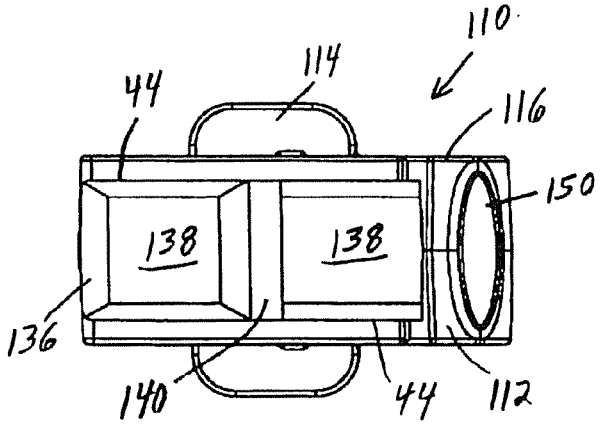
FIG. 19 is a front view of FIG. 16.
Figure 20:
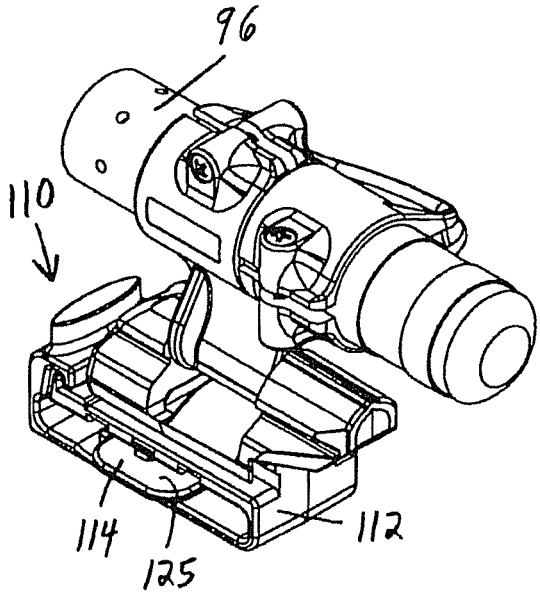
FIG. 20 is a left side perspective view of an adjustable rail light mount attached to the belt mount of FIG. 13.
Figure 21:
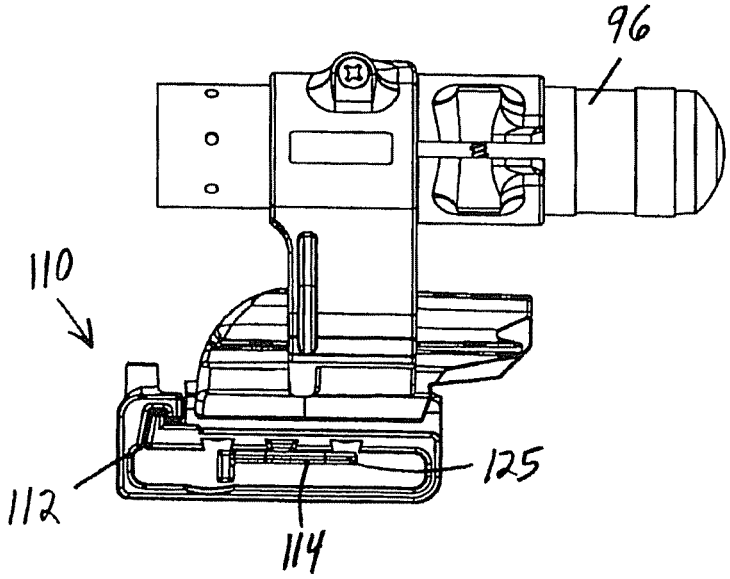
FIG. 21 is a left side view of the adjustable rail light mount of FIG. 20 attached to the belt mount of FIG. 13.
Figure 22:
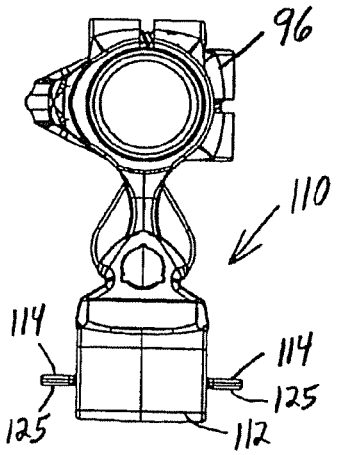
FIG. 22 is a bottom plan view of FIG. 21.
Figure 23:
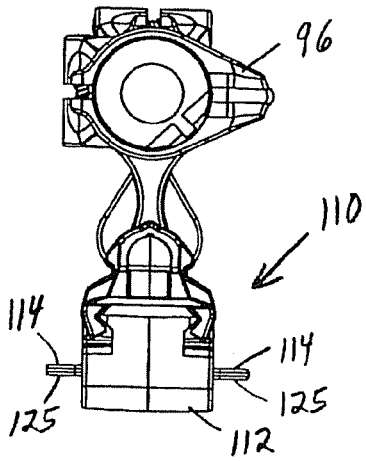
FIG. 23 is a top plan view of FIG. 21.

Referring now to FIGS. 13 and 16-19, the body 112 of the belt mount 110 comprises a belt aperture 18 (see FIGS. 13 and 16), three spaced sizing slots 119 (see FIGS. 13 and 16), and a rail 136 (see FIGS. 13, 18, and 19). The belt aperture 18 extends substantially the length of the body 112 of the belt mount 110 and is used to receive the belt 92 (see FIGS. 11 and 12). The rail 136 is located forward of the belt aperture 18 and substantially above a lower portion 116 (see FIGS. 13, 16, and 19) of the body 112. The sizing slots 119 extend through a wall 22 (see FIGS. 13 and 16) of the body 12 that is positioned between the belt aperture 18 and the rail 136 and into a portion of the rail 136. Each sizing slot 119 is dovetailed and dimensioned for receiving the belt sizing insert 114, as described above with reference to FIGS. 7-10.

Referring now to FIGS. 13, 16, and 19, the rail 136 of the body 112 of the belt mount 110 is used here to receive a rail light mount 96 (see FIGS. 20-23), as is known in the art. The rail 136 comprises ridges 138 with intervening slots 140. Opposing sides 44 of the rail 36 slope inwardly at approximately a forty-five degree angle.

Figure 14:
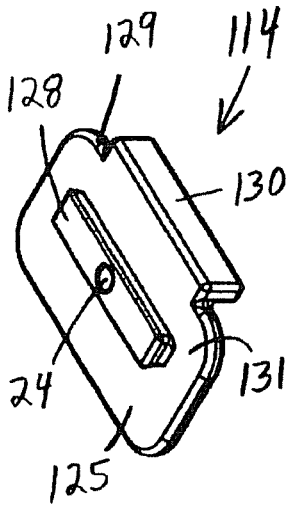
FIG. 14 is a front perspective view of the belt sizing insert of the belt mount shown in FIG. 13.
Figure 15:
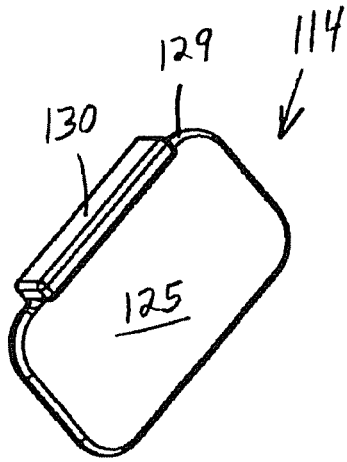
FIG. 15 is a rear perspective view of FIG. 14.

Referring now to FIGS. 14 and 15, the belt sizing insert 114 comprises a planar portion 125 and a delimiting portion 130. The delimiting portion 130 is formed integral with the planar portion 125 and extends substantially perpendicuarly from an end 129 of the planar portion 125. The delimiting portion 130 is centrally located along the end 129 such that generally equal portions of the planar portion 125 extend beyond each of opposing ends of the delimiting portion 130.

Continuing with FIGS. 14 and 15, a retaining body 128 extends centrally from an upper surface 131 (see FIG. 14) of the planar portion 125 and is formed integral with the upper surface 131. The retaining body 128 is used both to guide the belt sizing insert 114 into one of the sizing slots 119 (see FIGS. 13 and 16) and to secure the sizing insert 114 within the sizing slot 119, as described above with reference to FIGS. 7-10.

Referring now to FIGS. 17-19, once the belt sizing insert 114 has been inserted and secured within the selected sizing slot 119 (see FIGS. 13 and 16), the planar portion 125 (see FIGS. 14 and 15) of the belt sizing insert 114 will extend beyond either side of the body 112 of the belt mount 110, providing lateral stabilization for the wearer 90 (see FIGS. 11 and 12) of a thin belt 92 (see FIGS. 11 and 12), as described below with reference to FIGS. 20-23. Note that the belt sizing insert 114 can be used with other embodiments of the belt mount 110 as well.

Referring now to FIGS. 20-23, the belt sizing insert 114 is placed within the belt mount 110 (or sometimes not in some circumstances) and the belt mount 110 is positioned on the belt 92 (see FIGS. 11 and 12), substantially as described above with reference to FIG. 6 and with reference to FIGS. 7-10. Once the belt mount 110 has been placed on the belt 92, the rail light mount 96 can be placed on the belt mount 110 substantially as described above with reference to FIGS. 11 and 12. To secure the rail light mount 96 to the belt mount 110, the rail light mount 96 is rotated either left or right, relative to the longitudinal axis of the rail light mount 96, to engage the rail 136 (see FIGS. 13, 16, 18, and 19) of the body 112 of the belt mount 110 and secure the rail light mount 96 in place, as is known in the art. Note that the increased size of the planar portion 125 of the belt sizing insert 114 provides additional leverage for the wearer 90 (see FIGS. 11 and 12) of a thin belt 92 (see FIGS. 11 and 12) when rotating the rail light mount 96 to secure it in place. The rail light mount 96 may also be attached to the belt mount 110 prior to securing the belt mount 110 to the belt 92.

Figure 24:
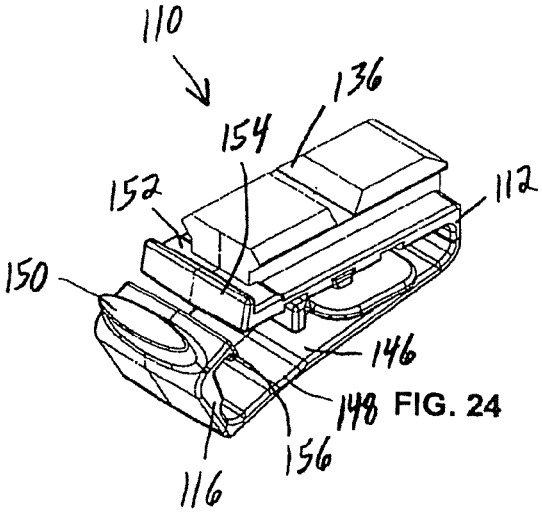
FIG. 24 is a bottom perspective view of the belt mount shown in FIG. 13 with forward and rearward portions separated to accept a belt.
Figure 25:
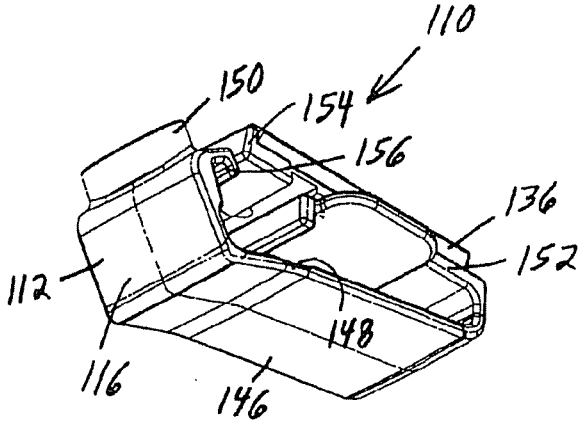
FIG. 25 is a rear perspective view of FIG. 24.
Figure 26:
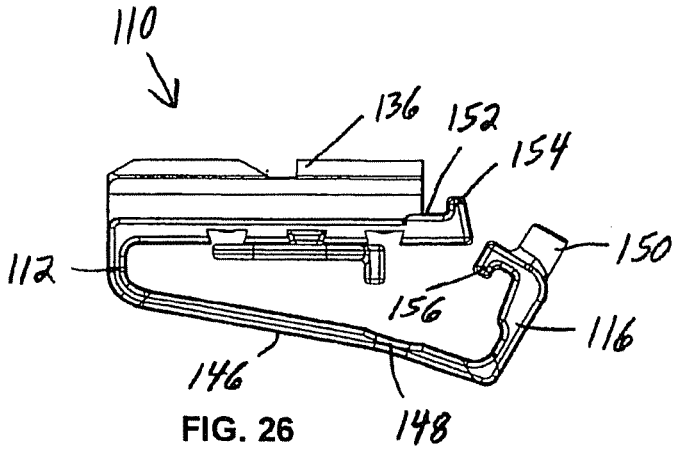
FIG. 26 is a right side view of the belt mount shown in FIG. 24.

Referring now to FIGS. 24-26, the body 112 of the belt mount 110 further includes a rearward portion 146 and a forward portion 152. An unlocking tab 150 is located atop the forward portion 152, positioned centrally of the lower portion 116 of the body 112. The forward portion 152 comprises two lateral interlocking flanges 154, 156 located proximate where the rail 136 meets the lower portion 116. A first interlocking flange 154 is oriented forwardly and a second interlocking flange 156 is oriented rearwardly. The interlocking flanges 154, 156 overlap, thereby locking the forward portion 152 together.

Continuing with FIGS. 24-26, the wearer 90 (see FIGS. 11 and 12) applies pressure to the unlocking tab 150 to move the lower portion 116 of the body 112 downwardly and rearwardly, forcing apart the interlocking flanges 154, 156. The rearward portion 146 of the body 112 flexes rearwardly, moreso at a shallow notch 148 located in the rearward portion 146 and positioned generally in line with where the rail 136 meets the lower portion 116. The wearer 90 then clips the belt mount 110 over the belt 92 (see FIGS. 11 and 12) so that the belt 92 is fitted between the rearward 146 and forward portions 152. The wearer 90 now snaps the interlocking flanges 154, 156 back together, relocking the forward portion 152.

FIGS. 27-32 depict a third preferred embodiment of an adjustable belt mount 210, in accord with the present invention. In a number of respects, the present embodiment 210 is substantially the same as the first preferred embodiment 10 (see FIGS. 1-12). In the present embodiment, the belt mount 210 includes a mounting plate 260 for attaching articles to the belt mount 210.

Figure 30:
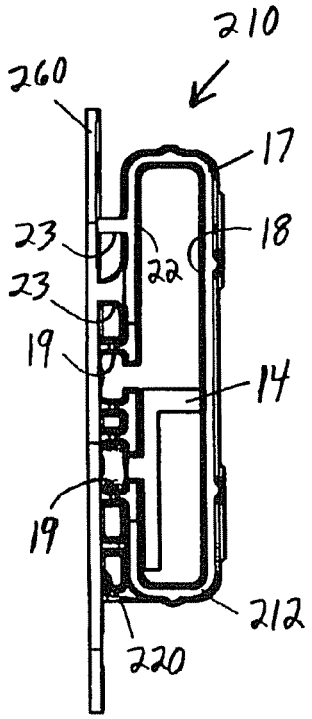
FIG. 30 is a left side elevational view of the belt mount of FIG. 27 with the removable belt sizing insert inserted into the body of the belt mount.
Figure 31:
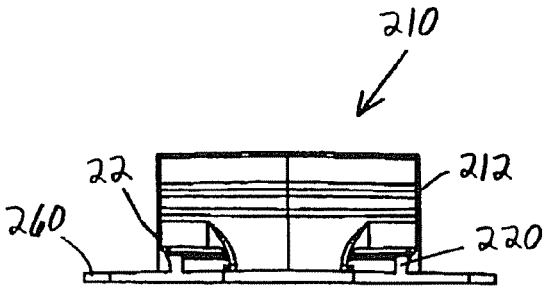
FIG. 31 is a bottom plan view of FIG. 28.
Figure 32:
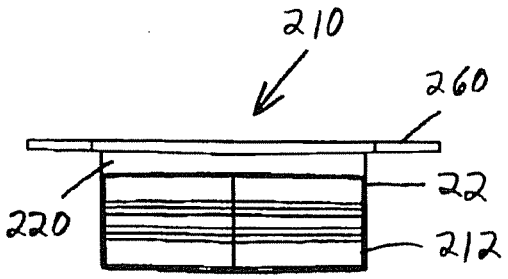
FIG. 32 is a top plan view of FIG. 28.

Referring now to FIGS. 27-32, the belt mount 210 comprises a body 212 and a belt sizing insert 14 (see FIG. 30). A belt 92 (see FIGS. 11 and 12) is inserted through the body 212 of the belt mount 210, as described above with reference to FIGS. 6-10, to secure the belt mount 210 to the belt 92. The sizing insert 14 can be inserted into the body 212 of the belt mount 210 in different locations and in different attitudes, as described above with reference to FIG. 6 and with reference to FIGS. 7-10.

Continuing with FIGS. 27-32, the body 212 of the belt mount 210 comprises a belt aperture 18 (see FIGS. 27, 29, and 30), a pair of spaced sizing slots 19 (see FIGS. 27, 29, and 30), a forward extension 220 (see FIGS. 27 and 29-32), and the mounting plate 260. The belt aperture 18 extends substantially the length of the body 212 of the belt mount 210 and is used to receive the belt 92. The forward extension 220 is located forward of the belt aperture 18 and substantially below an upper portion 17 (see FIGS. 27-30) of the body 212. The forward extension 220 contains a plurality of dished out areas 23 (see FIGS. 29 and 30) that are included to reduce material costs and the weight of the body 212, as is commonly known in the art of plastic molding. The sizing slots 19 extend through a wall 22 (see FIGS. 27 and 29-32) of the body 212 that is positioned between the belt aperture 18 and the forward extension 220 and into a portion of the forward extension 220. Each sizing slot 19 is T-shaped and dimensioned for receiving the belt sizing insert 14, as described above with reference to FIGS. 7-10. The substantially planar mounting plate 260 is supported by the forward extension 220 and is positioned forward thereof.

Figure 27:
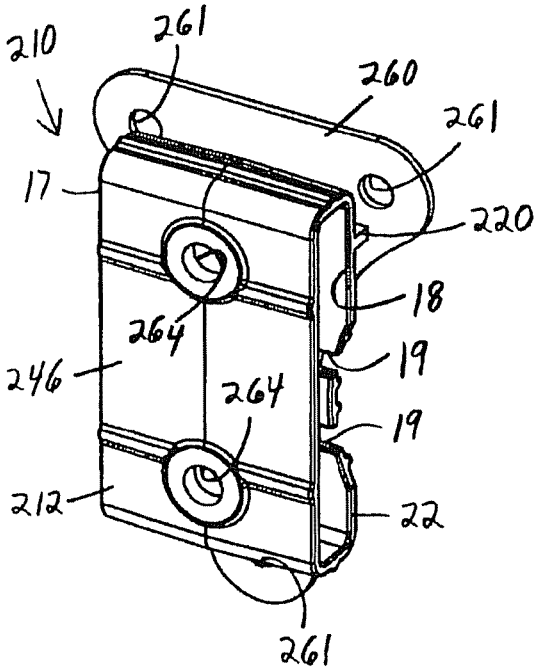
FIG. 27 is a rear perspective view of a third embodiment of an adjustable belt mount including a body and a removable belt sizing insert, in accord with the present invention, but with the belt sizing insert removed.
Figure 28:
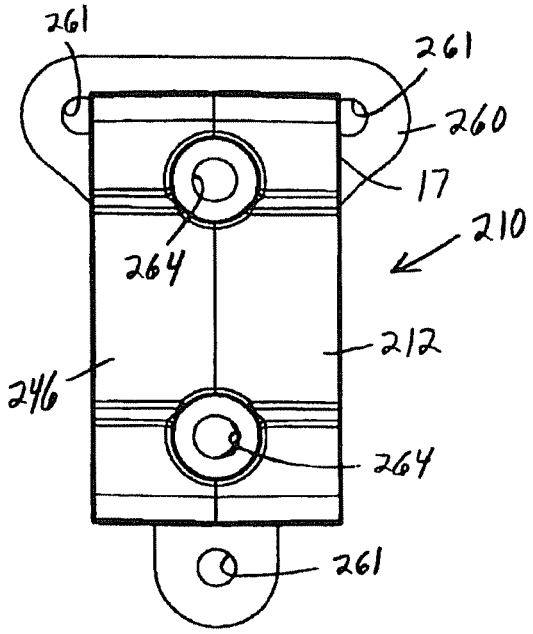
FIG. 28 is a rear elevational view of the body of the belt mount of FIG. 27.
Figure 29:
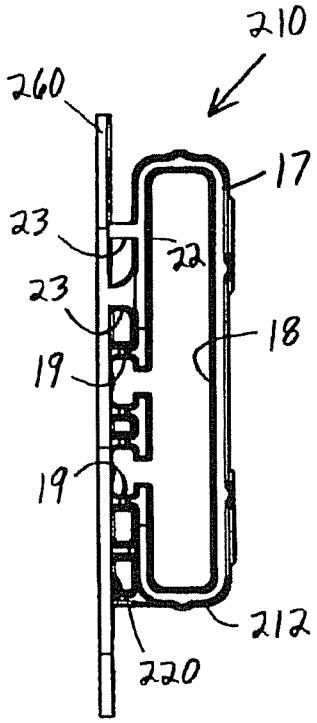
FIG. 29 is a left side elevational view of FIG. 28.

Referring now to FIGS. 27 and 28, the substantially planar mounting plate 260 is T-shaped with a pair of spaced holes 261 in an upper portion thereof and one hole 261 in a lower portion thereof. The mounting plate 260 is supported by the forward extension 220 and is positioned forward thereof. The mounting plate 260 is positioned relative to the body 212 of the belt mount 210 such that the body 212 of the belt mount 210 (excluding the mounting plate 260) does not interfere with access to the holes 261 for placement of fasteners therein.

Continuing with FIGS. 27 and 28, the body 212 of the belt mount 210 also includes a rearward portion 246. Holes 264 in the rearward portion 246 provide a way of mounting the belt mount 210 with its attached article to another type of platform other than a belt 92 (see FIGS. 11 and 12), such as to a tactical leg plate, as is known in the art.

Still referring to FIGS. 27 and 28, the belt sizing insert 14 (see FIG. 30) is placed within the belt mount 210 (or sometimes not in some circumstances) and the belt mount 210 is positioned on the belt 92, substantially as described above with reference to FIG. 6 and with reference to FIGS. 7-10. Once the belt mount 210 has been placed on the belt 92, an article can be secured to the mounting plate 260 of the body 212 of the belt mount 210 by passing fasteners through the holes 261 of the mounting plate 260. The article may also be secured to the belt mount 210 prior to securing the belt mount 210 to the belt 92.

FIGS. 33-36 depict a fourth preferred embodiment of an adjustable belt mount 310, in accord with the present invention. In a number of respects, the present embodiment 310 is substantially the same as the first preferred embodiment 10 (see FIGS. 1-12). In the present embodiment, the belt mount 310 includes a backing 370 for attaching articles to the belt mount 310.

Figure 33:
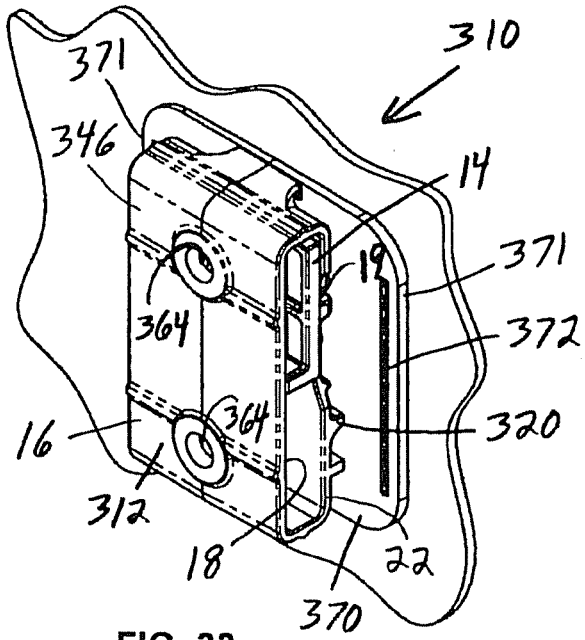
FIG. 33 is a rear perspective view of a fourth embodiment of an adjustable belt mount including a body and a removable belt sizing insert, in accord with the present invention.

Referring now to FIGS. 33-36, the belt mount 310 comprises a body 312 and a belt sizing insert 14 (see FIG. 33). A belt 92 (see FIGS. 11 and 12) is inserted through the body 312 of the belt mount 310, as described above with reference to FIGS. 6-10, to secure the belt mount 310 to the belt 92. The sizing insert 14 can be inserted into the body 312 of the belt mount 310 in different locations and in different attitudes, as described above with reference to FIG. 6 and with reference to FIGS. 7-10.

Continuing with FIGS. 33-36, the body 312 of the belt mount 310 comprises a belt aperture 18 (see FIGS. 33 and 35), a pair of spaced sizing slots 19 (see FIGS. 33 and 35), a forward extension 320 (see FIGS. 33, 35, and 36), and the backing 370. The belt aperture 18 extends substantially the length of the body 312 of the belt mount 310 and is used to receive the belt 92. The forward extension 320 is located forward of the belt aperture 18 and substantially above a lower portion 16 (see FIGS. 33-35) of the body 312. The forward extension 320 contains a plurality of dished out areas 23 (see FIG. 35) that are included to reduce material costs and the weight of the body 312, as is commonly known in the art of plastic molding. The sizing slots 19 extend through a wall 22 (see FIGS. 33, 35, and 36) of the body 312 that is positioned between the belt aperture 18 and the forward extension 320 and into a portion of the forward extension 320. Each sizing slot 19 is T-shaped and dimensioned for receiving the belt sizing insert 14, as described above with reference to FIGS. 7-10.

Still referring to FIGS. 33-36, the substantially planar backing 370 is supported by the forward extension 320 and is positioned forward thereof. The body 312 of the belt mount 310 (excluding the backing 370) is located centrally between opposing sides 371 of the backing 370 such that a portion of the backing 370 extends to either side of the belt mount 310. A pair of spaced stitching templates 371 are located proximate to one pair of opposing sides 371 of the backing 370, with each stitching template 371 located beyond a respective edge of the belt mount 310. It is to be understood that the stitching templates 371 may be either horizontally or vertically disposed. In the present embodiment, the belt mount 310 is envisioned to be made of a stiff, flexible, plastic material.

Figure 34:
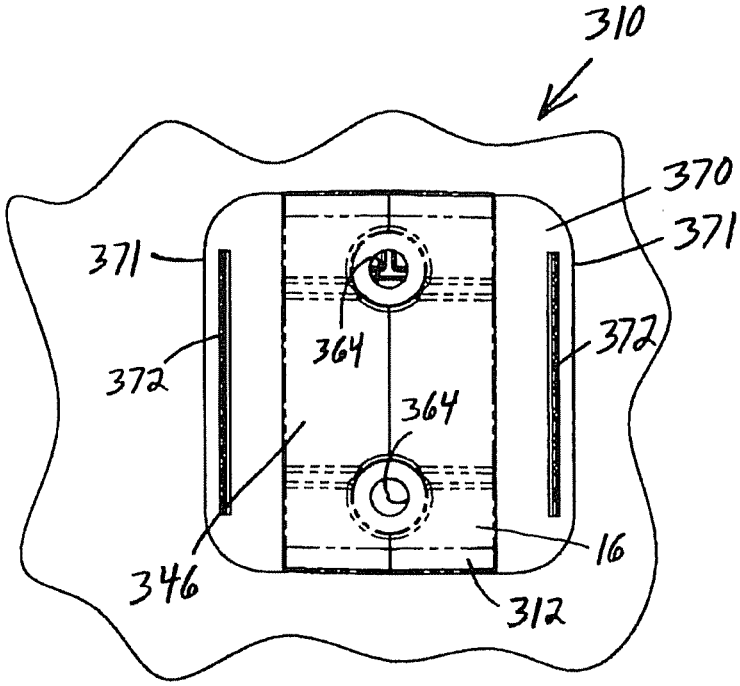
FIG. 34 is a rear elevational view of the belt mount of FIG. 33.
Figure 35:
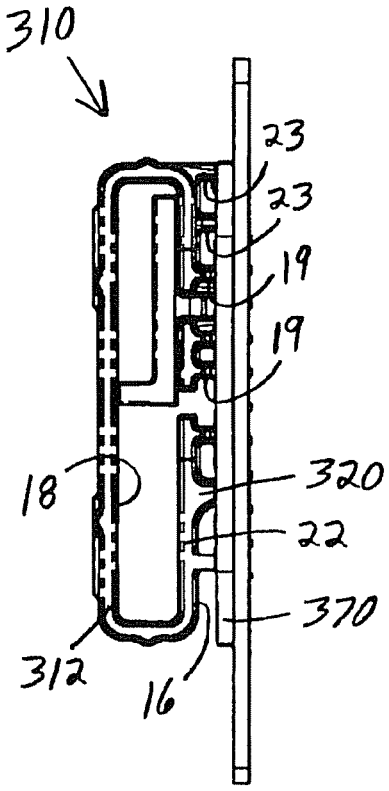
FIG. 35 is a right side elevational view of FIG. 34.
Figure 36:
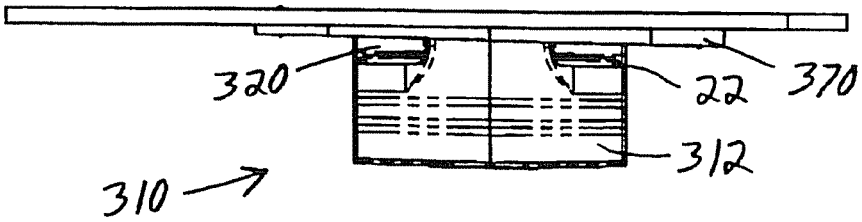
FIG. 36 is a top plan view of FIG. 34.

Referring now to FIGS. 33 and 34, the body 312 of the belt mount 310 also includes a rearward portion 346. Holes 364 in the rearward portion 346 provide a way of mounting the belt mount 310 with its attached article to another type of platform other than a belt 92 (see FIGS. 11 and 12), such as to a tactical leg plate, as is known in the art.

Continuing with FIGS. 33 and 34, an article, such as an article made of nylon or leather, is secured to the backing 360 of the body 312 of the belt mount 310 by applying stitching through the stitching templates 372 of the backing 360 and into the article, thereby securely stitching the article to the belt mount 310. The belt sizing insert 14 (see FIG. 33) is then placed within the belt mount 310 (or sometimes not in some circumstances) and the belt mount 310 is positioned on the belt 92, substantially as described above with reference to FIG. 6 and with reference to FIGS. 7-10. Although it is possible to secure the belt mount 310 to the belt 92 prior to sewing the article to the belt mount 310, it is not necessarily practical to do so.

It is to be recognized that the first, third and fourth embodiments of an adjustable belt mount 10, 210, 310 described hereinabove, as well as alternate embodiments, can be configured so as to clip onto a belt 92 (see FIGS. 11 and 12) substantially as described in FIGS. 24-26 of the second preferred embodiment of an adjustable belt mount 110 described hereinabove.

While the invention has been described with respect to certain specific embodiments, it will be appreciated that many modifications and changes may be made by those skilled in the art without departing from the spirit of the invention. It is intended, therefore, that the present invention not necessarily be limited to the embodiments herein shown and described.

What is claimed is:

1. An adjustable belt mount comprising:

a belt mount body having defined therein a belt passageway to receive a belt therethrough in a longitudinal direction and a first elongated continuous belt sizing slot extending along the belt length in the longitudinal direction and having opposed unobstructed open ends and communicating with the belt passageway; and a single belt sizing insert being slidable along the longitudinal direction from either of said open ends and removably received by the first belt sizing slot and having a portion thereof extending into the belt passageway.

2. The adjustable belt mount of claim 1, wherein the belt mount body includes an integral unitary forward extension adapted to releasably connect an accessory thereto.

3. The adjustable belt mount of claim 2, wherein the forward extension includes a mounting plate.

4. The adjustable belt mount of claim 3, wherein the mounting plate is adapted for connection to a tactical leg plate.

5. The adjustable belt mount of claim 3, wherein the mounting plate includes a stitching template.

6. The adjustable belt mount of claim 2, wherein the forward extension includes an integral rail defined by a pair of parallel upper and lower walls, the rail including a plurality of ridges with slots between the upper and lower walls and the lower wall of the rail extending above and closely adjacent to a top surface of a lower one of the ridges.

7. The adjustable belt mount of claim 1, wherein the first belt sizing slot is generally T-shaped.

8. The adjustable belt mount of claim 1, wherein the belt mount body and the belt sizing insert are configured such that the belt sizing insert is slidably removable from the first belt sizing slot, rotatable substantially 180 degrees and slidably reinsertable into the first belt sizing slot at either of the open ends, the belt sizing insert further includes a planar portion and a retaining body extending away from and located medially of the planar portion and releasably received by the first belt sizing slot.

9. The adjustable belt mount of claim 8, wherein the retaining body is generally T-shaped.

10. The adjustable belt mount of claim 8, wherein a receiving detent is defined in the retaining body medially thereof and the belt mount body includes a locking boss medially thereof releasably engaged by the receiving detent.

11. The adjustable belt mount of claim 1, wherein the belt mount body further includes a second elongated continuous belt sizing slot extending parallel to and spaced from the first belt sizing slot and having opposed open ends and communicating with the belt passageway, the second belt sizing slot adapted to slidably and removably receive the belt sizing insert the first and second belt sizing slots being equal in length.

12. The adjustable belt mount of claim 7, wherein the belt sizing insert is generally L-shaped and has a single T-shaped elongated rib on a planer larger portion thereof extending parallel to a smaller portion thereof, the rib being slidable in the T-shaped slot.

13. The adjustable belt mount of claim 1, wherein the belt mount body includes forward and rearward portions releasably connected at first ends thereof and flexibly connected at second ends thereof to facilitate positioning of the aperture around the belt, the second ends of the belt mount body forward and rearward portions include interlocking flanges, the second end of one of the forward or rearward portions includes an unlocking tab for facilitating release of the interlocking flanges.

14. The adjustable belt mount of claim 1, wherein at least one mounting hole is defined extending into the belt mount body.

15. An adjustable belt mount comprising:

a belt mount body having an inner generally rectangular wall and a spaced outer generally rectangular wall substantially parallel thereto and having generally rectangular end walls therebetween and forming a belt passageway adapted to receive belts of various widths therethrough in a longitudinal direction, a first elongated continuous belt sizing slot extending substantially parallel to said end walls and in the longitudinal direction and having opposed unobstructed open ends; and a belt sizing insert slidable in the in the longitudinal direction removably received by and through either of said open ends of said first belt sizing slot and having a portion extending toward another of said side walls and forming a predetermined width passageway between said portion and one of said end walls.

16. The belt mount of claim 15 further comprising a second elongated continuous belt size mounting slot communicating with said belt aperture and spaced from said first belt sizing slot and being parallel thereto, the second belt sizing slot having opposed unobstructed open ends and being equal in length to the first belt sizing slot said belt sizing insert being slidably removable from said first belt sizing slot and slidably removably received in said second belt size mounting slot and forming another width passageway between said portion and another of said end walls.

17. The adjustable belt mount of claim 16, wherein the belt sizing slot is T-shaped, and the belt sizing insert is generally L-shaped and has a single T-shaped elongated rib on a planar larger portion thereof extending parallel to a smaller portion thereof, the rib being slidable in the T-shaped slot.

18. The adjustable belt mount of claim 17, wherein the belt mount body and the belt sizing insert are configured such that the belt sizing insert is slidably removable from the first belt sizing slot, rotatable substantially 180 degrees and slidably reinsertable into the first belt sizing slot at either of the open ends, the belt sizing insert further includes a planar portion and a retaining body extending away from and located medially of the planar portion and releasably received by the first belt sizing slot.

19. The adjustable belt mount of claim 18, wherein a receiving detent is defined in the retaining body medially thereof and the belt mount body includes a locking boss medially thereof releasably engaged by the receiving detent.

20. An adjustable belt mount comprising:

a belt mount body having defined therein a belt passageway adapted to receive a belt therethrough in a longitudinal direction, the belt and mount body having a first and second elongated belt sizing slots each having opposed open ends and being equal in length and spaced and extending parallel to each other and parallel to the belt length; the slots communicating with the belt passageway, the belt mount body including a forward extension adapted to releasably connect an accessory thereto;

a generally L-shaped single belt sizing insert arranged in the belt passageway, including a planar portion carrying a retaining body extending from a first side thereof and slidable along the longitudinal direction and releasably received by either of said open ends of either of the first and second belt sizing slots, to accommodate belts of differing widths, the sizing insert having a single T-shaped elongated rib extending along the longitudinal direction and located on a planar larger portion thereof extending parallel to a smaller portion thereof, the rib being slidable in the elongated slots which each are T-shaped; and the belt mount body having a side wall spaced from and extending parallel to the first and second belt sizing slots with the belt being slidable between the belt sizing insert and the side wall.

* * * * *